United States Patent [19]

Meng

[11] Patent Number: 5,061,395

[45] Date of Patent: Oct. 29, 1991

[54] HARD SURFACE CLEANING COMPOSITION

[75] Inventor: Quentin J. Meng, Strongsville, Ohio

[73] Assignee: Ques Industries, Inc., Cleveland, Ohio

[21] Appl. No.: 461,091

[22] Filed: Jan. 4, 1990

[51] Int. Cl.[5] ..... C11D 1/62; C11D 7/06; C11D 7/12; C11D 1/835

[52] U.S. Cl. ..... 252/173; 252/156; 252/174.21; 252/541; 252/547

[58] Field of Search ..... 252/156, 173, 174.21, 252/541, 547, DIG. 14

[56] References Cited

U.S. PATENT DOCUMENTS 3,717,589 2/1973 Feller et al. .
4,116,853 9/1978 Binns .
4,174,304 11/1979 Flanagan ..... 252/524
4,321,165 3/1982 Smith et al. .
4,690,779 9/1987 Baker et al. ..... 252/546
4,762,638 8/1988 Pollman et al. ..... 252/135
4,786,440 11/1988 Cooper et al. .

OTHER PUBLICATIONS

Hawley's *Condensed Chemical Dictionary* Van Nostrand Reinhold Company New York p. 825.

*Primary Examiner*—Paul Lieberman
*Assistant Examiner*—Alexander G. Ghyka
*Attorney, Agent, or Firm*—Pearne, Gordon, McCoy & Granger

[57] ABSTRACT

This invention relates to an alkaline cleaning composition particularly useful on hard surfaces having a pH greater than 7.5. The cleaning composition comprises a combination of a cationic surfactant and a nonionic surfactant with at least one chelating agent and an alkaline sodium compound, e.g., NaOH, to maintain the aqueous cleaning composition at a pH greater than 7.5.

10 Claims, No Drawings

HARD SURFACE CLEANING COMPOSITION

BACKGROUND OF THE INVENTION

There are various commercially available hard surface cleaning compositions consisting of small amounts of different surfactants, including nonionic and anionic detergents, solvents such as alcohols, glycol ethers, and alkaline constituents in water. However, the cleaning efficiency of these detergents results in minimal removal of a film thought to be electrostatically held to the hard surface. This film is commonly referred to as "road film" in the industry. Moreover, many of these cleaners necessitate repeated passes with a cleaning cloth or other sorbent to remove this film. Thus, although there are a number of consumer cleaning products, these products require brushing, scrubbing, or some other manual action while the cleaner is in the wet state to achieve effective cleaning. As a consequence, the purpose of this invention is the development of an aqueous cleaning composition which provides good results and requires no manual action other than a high pressure rinse while the cleaner is in the wet state.

For example, attempts to avoid some of these problems are suggested by U.S. Pats. Nos. 4,213,873 and 4,315,828, wherein relatively high molecular weight glycols, e.g., polymeric glycols, are used as a cleaning agent in combination with ammonia hydroxide, alcohols, and water as the solvent. However, to avoid streaking, it was necessary to thoroughly wipe the surface in order to loosen the soil into the cloth; otherwise, a residue generally remained on the surface.

Metal surfaces, and particularly aluminum and aluminum alloys, are presently cleaned with aqueous solutions of acid, including sulfuric acid and hydrofluoric acid, together with one or more surface-active agents or detergents. While these acid solutions are effective and have many advantages, there are many disadvantages associated with acid cleaning. For example, these acids are capable of dissolving most metals commonly utilized in cleaning equipment. Moreover, hydrofluoric acid is particularly unsatisfactory, since the acid and the rinse water containing the acid present environmental problems and are extremely dangerous to personnel.

To avoid the disadvantages of acid cleaners, various alkaline compositions have been formulated to eliminate the problems encountered with utilizing acids. The alkaline materials, however, raise new problems which have militated against their use commercially. For example, the use of alkali metal hydroxides may result in extensive etching of the metal, e.g., aluminum surfaces. There are a number of patents which disclose neutral or alkaline cleaning compositions for metal surfaces, including U.S. Pats. Nos. 3,975,215; 4,093,566; and 4,477,290. These patents suggest the use of an alkali metal hydroxide in combination with chelating agents and one or more anionic or nonionic surfactants.

SUMMARY OF THE INVENTION

Accordingly, it is a purpose of this invention to provide an alkaline aqueous cleaning composition useful for cleaning various hard substrates, e.g., metal surfaces.

It is another purpose of this invention to provide a cleaning solution requiring minimal manual action during the cleaning process.

It is still a further purpose of this invention to provide an aqueous cleaning composition comprising a unique combination of chelating agents with a cationic detergent and/or surfactant and one or more nonionic surfactants in an alkaline medium.

It is another purpose of this invention to provide a cleaning composition for cleaning metal substrates wherein the cleaning composition can be sprayed under pressure onto the surface, requiring substantially no additional effort other than a water rinse under pressure of the surface following the application of the cleaning composition.

The aqueous cleaning composition of this invention comprises an alkaline aqueous solution having a pH greater than about 7.5, and preferably greater than 9, comprising from about 0.1 to 5.0 parts by weight of a water-soluble cationic surfactant or detergent, 0.1 to 5.0 parts by weight of at least one water-soluble nonionic surfactant, 0.5 to 15 parts by weight of at least one chelating agent, about 10 to 1000 parts, e.g., 50 to 500, by weight of water, and an effective amount of at least one alkaline sodium compound, e.g., 0.1 to 3.0 parts, by weight of sodium hydroxide, sufficient to maintain the aqueous cleaning composition at a pH above about 7.5, and preferably above 9.0.

DETAILED DESCRIPTION OF THE INVENTION

This invention relates to a substantially non-streaking alkaline cleaning composition and to the method of using said composition for cleaning hard surfaces, which comprises (a) from about 0.1 to 5.0 parts by weight of at least one water-soluble cationic surface-active agent or detergent, and preferably from about 1.0 to 2.0 parts by weight of at least one water-soluble cationic surfactant or detergent, such as Ethoquad C/25; (b) 0.1 to 5.0 parts by weight, and preferably 0.5 to 2.0 parts by weight of at least one nonionic surfactant, such as the alkylated phenolic ethoxylates; (c) about 0.5 to 15 parts by weight, and preferably from about 2 to 5 parts by weight of at least one chelating agent, such as the sodium salt of nitrilotriacetic acid (NTA) or ethylenediaminetetraacetic acid (EDTA); (d) about 10 to about 1000 parts by weight of water; and (e) an effective amount of at least one alkaline sodium compound, such as 0.1 to 3.0 parts of sodium hydroxide, to maintain the aqueous solution at a pH above about 7.5, and preferably above 9.0.

The alkali metal salts of either ethylenediaminetetraacetic acid or nitrilotriacetic acid are preferably the sodium salt, although the lithium and potassium salts may be employed. The salt is either the di, tri, or tetra alkali metal salts, or a mixture thereof. While the lower molecular weight ethyleneamine polycarboxylic acids, e.g., EDTA and DTA, are useful for purposes of this invention, it is also possible to utilize the higher molecular weight compounds, such as triethylenetetraaminehexaacetic acid (TTHA), and the higher molecular weight compounds such as tetraethylenepenta amine heptaacetic acid (TTPHA), either alone or in combination, with other known polycarboxylic acid chelating agents.

The following nonionic surfactants and/or combinations thereof may be used in the practice of this invention, and include, for example:

(a) nonylphenoxy polyethoxy ethanol (sold by Rohm and Haas Co. under the trademark "TRITON" N 100);

(b) modified polyethoxy adduct (sold by Rohm and Haas Co. under the trademark "TRITON" CF 76);

(c) an alkyl polyethoxylated ether (sold by Jefferson Chemical Co. under the trademark "SURFONIC" LF 17);

(d) a modified ethoxylated straight chain alcohol (sold by BASF Wyandotte Corp. under the trademark "PLURAFAC" D-25);

(e) an ethoxylated abietic acid derivative (sold by Hercules, Inc. under the trademark "SURFACTANT AR 150"); and/or (f) block copolymers of about 90% polyoxypropylene and about 10% polyoxyethylene (sold by BASF Wyandotte Corp. under the trademark "PLURONIC" 31R1).

These nonionic surfactants may be broadly defined as compounds, aliphatic or alkyl aromatic in nature, which do not ionize in water. For example, a well-known class of nonionic synthetic detergents is available under the trade name "TERGITOL." These compounds are formed by condensing ethylene oxide, alternatively propylene oxide, with an alcohol. The hydrophobic portion of the molecule which exhibits water insolubility has a total carbon chain length of from about 8 to about 20 carbon atoms. The addition of polyoxyethylene radicals to the hydrophobic portion tends to increase the water solubility of the molecule. The method of making these surfactants, which comprises reacting the alkylene oxide and the long chain alcohol in the presence of an acid catalyst, is well known. Other commercial nonionic surfactants include the Tritons, Tergitols, and Neodols, (which is manufactured by the Shell Oil Co).

Still other known nonionic surfactants include:

(g) the polyethylene oxide condensates of alkylphenols; the condensation products of alkylphenols or dialkylphenols wherein the alkyl group contains from about 6 to 12 carbon atoms in either a straight chain or branched chain configuration with ethylene oxide, the ethylene oxide being present in amounts equal to about 3 to 25 moles of ethylene oxide per mole of alkylphenol; and (h) the condensation product of aliphatic alcohols having from 8 to 18 carbon atoms, in either straight chain or branched chain configuration, with ethylene oxide, e.g., an alcoholethylene oxide condensate having from about 3 to 30 moles of ethylene oxide per mole of alcohol, the alcohol fraction having from 10 to 14 carbon atoms.

In general, the non-ionic detergent or surfactants used for purposes of this invention belongs to a class of compounds formed by condensation of an alkyl phenol, an alkyl amine, or an aliphatic alcohol with sufficient ethylene oxide to produce a compound having a polyoxyethylene chain within the molecule, i.e., a chain composed of recurring ($-O-CH_2-CH_2-$) groups. Many compounds of this type are known and used for their detergent, surface-active, wetting and emulsifying properties. The compounds which are useful in the present invention are those produced by condensation of about 4–16, and preferably 4–12 moles, of ethylene oxide with one mole of a compound selected from the group consisting of an alkyl phenol having about 1–15, and preferably 7–10, carbon atoms in the alkyl group; an alkyl amine having about 10–20, and preferably 12–16, carbon atoms in the alkyl group; an aliphatic alcohol having about 10–20, and preferably 12–16, carbon atoms in its molecule; and a hydrophobic group formed by condensing propylene oxide with propylene glycol. Mixtures of two or more of the non-ionic detergents or surfactants identified above may also be used. The number of moles of ethylene oxide which are condensed with one mole of the compound, i.e., the alkyl phenol, the alkyl amine, or the aliphatic alcohol, depends upon the molecular weight of the hydrophobic portion of the condensation product. The non-ionic compound used should have sufficient ethylene oxide units to ensure solubility thereof in the cleaning composition.

The preferred alkyl phenols which are condensed with ethylene oxide to give a non-ionic detergent useful in the invention are phenols wherein the alkyl group contains about 1–15, and preferably about 7–10, carbon atoms in a straight or branched chain, e.g., saturated or unsaturated. In a particularly preferred embodiment, the non-ionic detergent is a mixture produced by condensation of 75% of 8–12 moles of ethylene oxide with 1 mole of nonyl phenol and 25% of 4–5 moles of ethylene oxide with 1 mole of nonyl phenol. Examples of other alkylphenol-ethylene oxide condensation products are compounds wherein the hydrophobic portion of the product is formed from phenol, methyl phenol (cresol), ethyl phenol, hexyl phenol, octyl phenol, decylphenyl, dodecylphenol, and the like.

The cationic surface-active agents used in the invention are the quaternary ammonium halide surfactants having the formula:

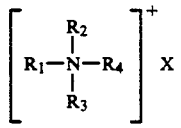

(a) wherein $R_1$ and $R_2$ are lower (i.e., $C_1$–$C_7$) alkyl, and preferably methyl groups; R3 is a phenyl group or a phenyl group substituted with an alkyl group having about 1–18 carbon atoms or an alkyl group having about 8–20, and preferably 8–18, carbon atoms; R4 is a phenyl group or a phenyl group substituted with an alkyl group having about 1–18 carbon atoms or an alkyl group having about 8–20, and preferably 8–18, carbon atoms; and X is a halogen, preferably chlorine. Examples of suitable quaternary ammonium halide surfactants include dioctyl dimethyl ammonium chloride, octyl decyl dimethyl ammonium chloride, didecyl dimethyl ammonium chloride, ($C_{12}$–$C_{18}$) n-alkyl dimethyl benzyl ammonium chloride, ($C_{12}$–$C_{14}$) n-alkyl dimethyl ethylbenzyl ammonium chloride, and dimethyl (difatty) ammonium chloride. Particularly preferred examples of quaternary ammonium halide surfactants are used as mixtures of about (34% by weight $C_{12}$ and 16% by weight $C_{14}$ n-alkyl dimethyl ethylbenzyl ammonium chloride, and about (30% by weight $C_{14}$, 15% by weight $C_{16}$, 2½% by weight $C_{12}$, and 2½% by weight $C_{18}$) n-alkyl dimethyl benzyl ammonium chloride, or (b) wherein $R_1$, $R_2$, and $R_3$ are lower (i.e., $C_1$–$C_7$) alkyl, and preferably methyl groups; $R_4$ is an alkyl or phenyl-substituted alkyl group having about 8–20, and preferably 8–18, carbon atoms; and X is a halogen, or (c) wherein $R_1$ is an alkyl or phenyl-substituted alkyl group having about 10–20, and preferably 12–16 carbon atoms; $R_2$ is lower (i.e., $C_1$–$C_7$) alkyl, and preferably a methyl group; $R_3$ is $[-CH_2C-H_2-O-]_xH$ and $R_4$ is $[-CH_2CH_2O-]_yH$, with the sum of $x+y$ varying between about 2 and 50. Examples of these compounds are those sold by AKZO Chemical Inc. under the trade names Ethoquad 18/12, Ethoquad C/25, and Ethoquad 0/25.

Since the pH or alkalinity of the cleaning composition is critical, variations in the pH caused by extraneous factors may require adjustment of the alkalinity. The pH is controlled by varying the amount of the potassium or sodium compounds, e.g., sodium or potassium hydroxide and/or sodium carbonate and the like, which is added to the solution to provide a pH at least as high as 7.5, and preferably a pH greater than 9.0, or even higher, ranging from about 11.0 to 12.5.

Other inorganic salts which may be used in combination with the alkali metal compounds, e.g., sodium or potassium hydroxide, include sodium carbonate and various mixtures thereof, provided the pH of the cleaning composition is maintained at least above about 7.5. The temperature while using the cleaning composition, e.g., under pressure from about 10–500 psi, should generally be maintained above freezing, e.g., 35°, and as high as about 200° F., and preferably at temperatures of about 50° F. to 150° F. The treatment time will vary, depending upon the nature and condition of the surface being cleaned, and generally will range anywhere from about 5 seconds to 20 minutes, and usually from about 10 seconds to 30 seconds, depending on the temperature and/or pressure at which the cleaner is applied. Following the cleaner application, the substrates are rinsed with water to remove soil and cleaning composition. The spent solution in rinse waters presents few problems, and therefore can be safely disposed of. For example, the salts of the chelating agents are readily biodegraded to relatively harmless components, whereas, the alkaline material in the solution can be neutralized by the addition of various acids until the pH is lowered.

The soiled surfaces to be cleaned by the composition of this invention include surfaces containing oily or greasy materials and other soils, as well as dust and dirt, etc. In many instances, while certain cleaners have extremely good cleaning qualities, they leave undesirable residues, resulting in smears or films. While some cleaners may be fairly non-streaking, it was found that their cleaning capability is limited. The cleaning composition of this invention, however, resulted in improved cleaning, including excellent non-streaking and non-film-forming characteristics and necessitating a minimum amount of wiping, if any, due to the combination of the cationic and nonionic surfactants, synergistically functioning with the chelating agent to effectively remove dirt or greasy residues.

In addition to the combination of the surfactants, i.e., the cationic and nonionic surfactants and the chelating agents, other adjuncts, such as dies and fragrances and the like which will not deposit on the surfaces, may be used in the aqueous composition. These ingredients may be added to the aqueous solution in small but effective amounts, if desirable, since water is the principal ingredient of the composition.

Water is present in the composition in amounts as low as about 10 parts, but can be diluted to as high as 1000 parts, and preferably in the range of about 50 to 500 parts by weight of water, depending on the particular polymeric surfactants and chelant used in the composition. Optimally, the cleaning composition contains from about 50 to 100 parts of water by weight of the total composition.

The following illustrates a typical cleaning composition for purposes of this invention.

EXAMPLE 1

| Components | Parts by Weight |
|---|---|
| Water | 10–1000 |
| Nitrilotriaacetic acid (sodium salt) | 0.5–15 |
| Soda ash (sodium carbonate) | ph of 9 |
| Caustic soda (sodium hydroxide) | ph of 9 |
| Nonylphenol ethoxylates | 0.1–5.0 |
| Quaternary ammonium halide (Ethoquad C/25) | 0.1–5.0 |

The cleaning composition of this invention may be applied to the surface, e.g., metal surfaces, by conventional methods, and particularly on large surfaces, by spraying the cleaner under pressures ranging from about 5 psi to 500 psi.

While this invention has been described by way of a number of specific embodiments, it is obvious that there are other variations or modifications which can be used without departing from the spirit and scope of the invention set forth in the appended claims.

The invention claimed is:

1. An alkaline aqueous cleaning composition for hard surfaces consisting of 0.1 to 5.0 parts by weight of a water-soluble quaternary ammonium halide, 0.1 to 5.0 parts by weight of at least one non-ionic surfactant derived from the condensation of an alkyl phenol or aliphatic alcohol and an alkylene oxide, 0.5 to 15 parts by weight of at least one water-soluble chelating agent, 10 to 1000 parts by weight of water, and an effective amount of at least one alkaline inorganic sodium compound to maintain the aqueous cleaning solution at a pH above 7.5.

2. A process for cleaning a hard surface which comprises applying to said surface an aqueous cleaning composition having a water temperature above about 35° F. at pressures ranging from about 10–500 psi; said cleaning composition consisting of 0.1 to 5.0 parts by weight of a water-soluble quaternary ammonium halide, 0.1 to 5.0 parts by weight of at least one non-ionic surfactant derived from the condensation of an alkyl phenol or aliphatic alcohol and an alkylene oxide, 0.5 to 15 parts by weight of at least one water-soluble alkaline metal salt of a lower molecular weight carboxylic acid, 10 to 1000 parts by weight of water, and an effective amount of at least one alkaline sodium compound to maintain the cleaning solution at a pH above 7.5.

3. The composition of claim 1 wherein the cationic surfactant is present in an amount of about 1.0 to 2.0 parts by weight, the nonionic surfactant is present in an amount of about 0.5 to 2.0 parts by weight, the chelating agent is present in an amount of about 0.5 to 15 parts by weight, and the water is present in an amount ranging from about 50 to 500 parts by weight.

4. The composition of claim 1 wherein the sodium compound comprises sodium hydroxide.

5. The composition of claim 1 wherein the non-ionic surfactant is a condensation product of ethylene oxide and an alkylphenol.

6. The composition of claim 5 wherein the condensation product is a nonylphenol ethoxylate.

7. The composition of claim 6 wherein at least one of the chelating agents is nitrilotriaacetic acid.

8. The composition of claim 7 wherein the chelating agent is a mixture of nitrilotriaacetic acid and ethylenediaminetetraacetic acid.

9. The composition of claim 8 wherein the cationic surfactant is a quaternary ammonium halide and the non-ionic surfactant is a condensation product of ethylene oxide and an alkylphenol.

10. The composition of claim 9 wherein the alkaline sodium compound is a combination of sodium hydroxide and sodium carbonate and the pH of the solution is maintained above 9.0.

* * * * *